US005524727A

United States Patent [19]

Yennie, Jr.

[11] Patent Number: 5,524,727

[45] Date of Patent: Jun. 11, 1996

[54] CONSTRUCTION WALL BRACKET

[76] Inventor: Roland Yennie, Jr., Box 515, Hammond, Minn. 55991-9616

[21] Appl. No.: 322,596

[22] Filed: Oct. 13, 1994

[51] Int. Cl.[6] ..... E04G 5/06

[52] U.S. Cl. ..... 182/82; 182/150

[58] Field of Search ..... 182/82, 150, 206

[56] References Cited

U.S. PATENT DOCUMENTS

| | | | |
|---|---|---|---|
| 2,670,248 | 2/1954 | Heller . | |
| 2,957,670 | 10/1960 | Wendl et al. . | |
| 3,134,567 | 5/1964 | Shoemaker . | |
| 3,510,097 | 5/1970 | McCaleb . | |
| 3,515,244 | 6/1970 | Weible . | |
| 3,964,116 | 6/1976 | Black . | |
| 4,256,201 | 3/1981 | Neighbors | 182/150 |
| 4,825,975 | 5/1989 | Symes | 182/150 |
| 4,911,264 | 3/1990 | McCafferty | 182/150 |
| 4,971,169 | 11/1920 | Fruth . | |
| 5,259,477 | 11/1993 | Fears et al. . | |

FOREIGN PATENT DOCUMENTS

| | | | |
|---|---|---|---|
| 12225970 | 7/1960 | France | 182/150 |
| 250300 | 8/1947 | Switzerland | 182/150 |

*Primary Examiner*—Alvin C. Chin-Shue
*Attorney, Agent, or Firm*—Palmatier, Sjoquist & Helget

[57] ABSTRACT

This invention relates to a construction wall bracket for use in the erection of residential structures. The construction wall bracket includes a vertical member having a pair of laterally and outwardly-extending stud engagement members which rest against the vertical wall. A horizontal member having an angle bracket extends horizontally outward from the vertical member to support a plank or platform for use by a workman during construction efforts. A support brace is affixed to the vertical member for engagement to the top horizontal stud of a wall. A swing arm having a depending end tab and a pair of longitudinally-extending hinge members is pivotally attached to the support brace about a hinge pin. The upward pivotal rotation of the swing arm with respect to the support brace facilitates the removal of the construction wall bracket during periods of non-use. A safety pin is engaged to the hinge members and against the support brace to prevent pivotal rotation of the swing arm with respect to the support brace during operational positioning and use of the construction wall bracket.

10 Claims, 3 Drawing Sheets

CONSTRUCTION WALL BRACKET

BACKGROUND OF THE INVENTION

Carpenters frequently use scaffolding during the construction of buildings. Various methods have been used for the support of these devices adjacent to the vertical studs of a wall during the construction of rafters, ceiling joists, or the roof of a structure, Some scaffold devices are adjustable and extend upwardly from a ground surface. Other scaffold devices hang from the top horizontal stud of a wall. Examples of scaffold devices include the Fruth U.S. Pat. No. 4,971,169; Fears et al, U.S. Pat. No. 5,259,477; Black U.S. Pat. No. 3,946,116; and Weible U.S. Pat. No. 3,515,244.

These above-identified scaffold devices lack a convenient mechanism for removal of the devices from, or relocation of the devices upon, a vertical wall. The above-identified devices require a workman to physically lift the scaffold device upwardly, while simultaneously manipulating the top and/or the safety members of the scaffold device outwardly, in order to disengage the safety hooks or hangers from the top horizontal stud of the wall. It is very difficult and inconvenient for a workman to attempt to simultaneously lift and manipulate a scaffold device due to the weight and clumsy size of each unit.

The present invention includes a convenient engagement and release mechanism for a construction wall bracket which significantly enhances a workman's ability to relocate the device upon, or remove the device from, the top horizontal stud of wall. A workman is thereby provided with the ability to easily and conveniently store the device during periods of non-use, or reposition the device to a desired location upon the top horizontal stud during ongoing construction of rafters, ceiling joists, or a roof.

SUMMARY OF THE INVENTION

This invention relates to a construction wall bracket for use in the erection of residential structures. The construction wall bracket includes a vertical member having at least one laterally and outwardly-extending stud engagement member which rests against the wall. A horizontal member having an angle bracket extends horizontally outward from the vertical member to support a plank or platform for use by a workman during construction efforts. A support brace having a swing arm is affixed to the vertical member for engagement to the top edge of a wall. The swing arm has a depending end tab and a hinge member pivotally attached to the support brace about a hinge pin. The upward pivotal rotation of the swing arm with respect to the support brace facilitates the removal of the construction wall bracket during periods of non-use. A safety pin is engaged to the hinge member to prevent pivotal rotation of the swing arm with respect to the support brace during operational use of the construction wall bracket.

It is a principal object of the present invention to provide a new and improved construction wall bracket having a convenient release mechanism of relatively simple and inexpensive design, construction, and operation, which is safe and durable and which fulfills the intended purpose for use in the construction of a building without fear of injury to persons or damage to property.

It is another principal object of the present invention to provide a construction wall bracket which is easily repositioned along the top horizontal stud of a wall by the manipulation of the release mechanism.

It is still another principal object of the present invention to provide a construction wall bracket having a convenient release mechanism which may be secured into a safety or engagement position preventing inadvertent separation of the construction wall bracket from the top horizontal stud of a wall.

A feature of the present invention is a vertical member having at least one wall engagement member extending laterally outward from the vertical member for positioning against the vertical wall of a building.

Another feature of the present invention includes a horizontal member which is affixed to and extends perpendicularly outward from the vertical member for use in the support of a platform used by a carpenter during construction activities.

Still another feature of the present invention is a support brace affixed to and extending perpendicularly inward from the vertical member for engagement to the top horizontal stud of a wall.

Still another feature of the present invention is a hinged swing arm affixed to the support arm.

Still another feature of the present invention is a swing arm including a depending end tab where the swing arm is positionable upon the top horizontal stud and the end tab is positionable adjacent to the top horizontal stud within the interior of the building for preventing the inadvertent separation of the construction wall bracket from a wall.

Still another feature of the present invention is a hinge pin engaged to the hinge member, permitting upward pivotal rotation of the swing arm with respect to the support brace for release of the construction wall bracket from a wall.

Still another feature of the present invention is a safety pin engageable to the hinge member for preventing pivotal upward rotation of the swing arm with respect to the support brace during use of the construction wall bracket.

DETAILED SPECIFICATION OF THE PREFERRED EMBODIMENT

Figure 1:
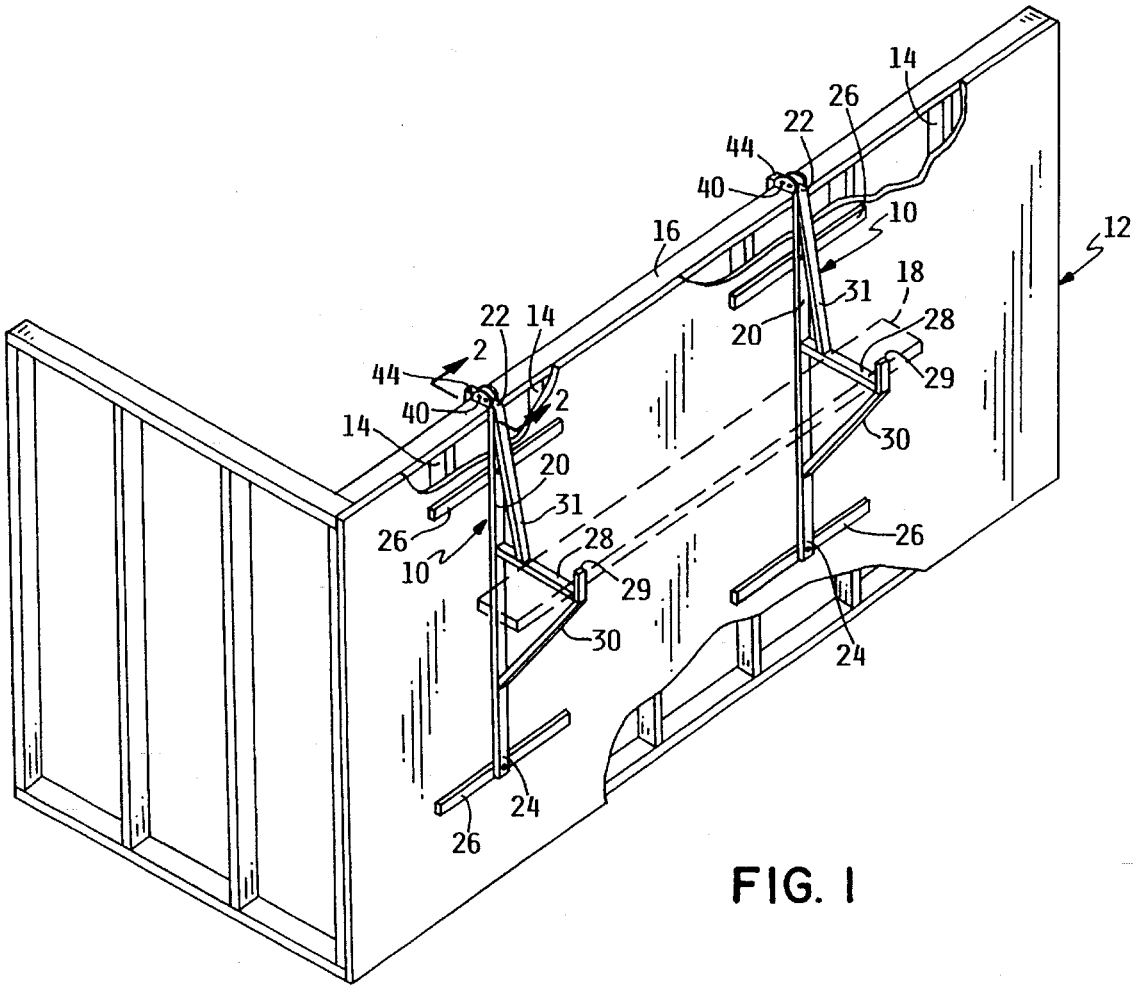
FIG. 1 is an environmental, partially-phantom line view in partial breakaway, of the construction wall bracket mounted to a vertical wall having vertical studs and a horizontal top stud.
Figure 3:
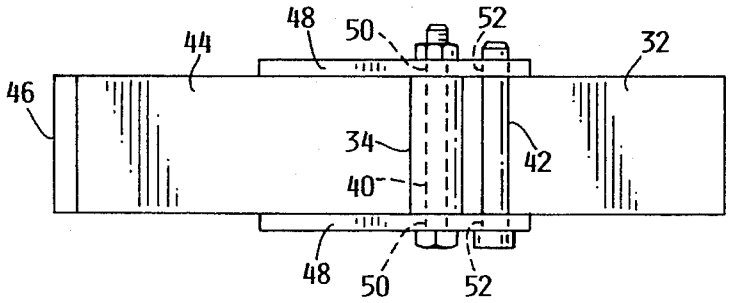
FIG. 3 is a top view of the hinge member.

One form of the invention is illustrated and described herein. In general, the construction wall bracket is indicated by the numeral 10. The wall bracket 10 is preferably used in construction projects during the erection of the rafters, ceiling joists, or roof of a residential building project.

The wall bracket 10 is particularly well suited for engagement to the top of a vertical wall 12. In general, the vertical wall 12 includes a plurality of vertical studs 14 and a top horizontal stud or cap 16. The wall bracket 10 preferably hangs from the top horizontal stud or cap 16 and functions as a scaffold for use by a workman.

The wall bracket 10 is specifically devised to traversely engage a pair of vertical studs 14 or the exterior surface of the vertical wall 12. At least one pair of wall brackets 10 are used on each vertical wall 12, being suitably spaced from each other, for support of a plank or platform 18 during construction efforts (FIG. 1). FIG. 1 shows two wall brackets 10 in operative position against the exterior surface of a vertical wall 12. It should be noted that any number of wall brackets 10 may be used for support of a plank or platform 18 at the discretion of a worker. Each wall bracket 10 is preferably releasably hung over the top horizontal stud 16 in order to facilitate the relocation or removal of the wall bracket 10 by a construction worker.

Each wall bracket 10 includes a vertical member 20. Each vertical member 20 preferably includes an upper end 22 which is positioned proximate to the top horizontal stud 16. Each vertical member 20 also preferably includes a lower end 24 which is positioned at a lower wall level. The vertical member 20 is positioned in a co-planar relationship to the vertical wall 12 when the wall bracket 10 is attached in an operable position.

The vertical member 20 provides structural support for the wall bracket 10 during use of the plank or platform 18 as a scaffold during construction efforts. It should be noted that the vertical member 20 is of sufficient strength and durability to not fracture, bend, or fail during use of the wall bracket 10 by a construction worker. The vertical member 20 may be of any length as preferred by a workman for use on construction projects.

A pair of horizontal stud engagement members 26 preferably extend laterally outward from the vertical member 20 for a sufficient distance to bridge adjacent vertical studs 14. Alternatively, a single stud engagement member 26 may be engaged to the vertical member 20 at the preference of an individual provided that rotation of the wall bracket 10 through the plane of the vertical studs 14 does not occur. Alternatively, any preferred number of stud engagement members 26 may be affixed to the vertical member 20 at the discretion of an individual. The stud engagement members 26 in operable position bridge the vertical studs 14 or rest against the exterior surface of a vertical wall 12 (FIG. 1).

Each stud engagement member 26 preferably extends laterally outward from the vertical member 20 in approximately the same plane as the vertical wall 12. In the preferred embodiment, one stud engagement member 26 is affixed to the vertical member 20 proximate to the upper end 22, and another stud engagement member 26 is affixed to the vertical member 20 proximate to the lower end 24.

A horizontal member 28 is preferably affixed to and extends perpendicularly outward from the vertical member 20. The horizontal member 28 functions as the support for the platform or plank 18. The horizontal member 28 may be of any length as preferred by a construction worker for support of any desired width of plank or platform 18. An end tab 29 is affixed proximate the outermost end of the horizontal member 28. End tab 29 serves to limit the outward movement of the plank or platform 18; it also serves as a mounting fixture for attachment of a suitable rail or railing. It should be noted that the horizontal member 28 is preferably formed of a material having a sufficient strength and durability to not fracture, bend, or fail during use of the wall bracket 10.

A support or angle bracket 30 is preferably affixed to the vertical member 20 and to the horizontal member 28. The support or angle bracket 30 preferably functions to provide additional support for the plank or platform 18 during use of the wall bracket 10. Each support or angle bracket 30 has two ends, where one of the ends is affixed to the horizontal member 28 outward from the vertical member 20 and the other end is affixed to the vertical member 20 below the horizontal member 28. A second support or angle bracket 31 is also affixed between vertical member 20 and horizontal member 28; the lower end of support or angle bracket 31 is affixed to horizontal member 28 a short distance outwardly from vertical member 20, and the upper end of support or angle bracket 31 is affixed to vertical member 28 proximate its upper end 22.

A support brace 32 is preferably attached to the upper end 22 of the vertical member 20. The support brace 32 preferably extends perpendicularly inward from the upper end 22 for resting upon, and engagement to, the top horizontal stud 16 during use of the wall bracket 10. The support arm 32 is preferably of sufficient strength and durability to not separate from either the vertical member 20 or the top horizontal stud 16 during use of the wall bracket 10.

A tubular hinge 34 is welded proximate the inner end of support brace 32. Tubular hinge 34 has an inside diameter which is sized to accept hinge pin 40, which may be formed by a hex bolt and lock nut combination. Tubular hinge 34 has a length equal to the width of support brace 32.

A swing arm 44 has a pair of welded hinge members 48 affixed thereto, and each hinge member 48 has an aperture 50 and an aperture 52. Aperture 50 is sized to receive the hinge pin 40, and aperture 52 is sized to receive a safety pin 42.

Swing arm 44 is preferably attached to the support brace 32 via hinge members 48 pivotally connected to the hinge pin 40. The swing arm 44 preferably is alignable with the support arm 32 for engagement against the outer end of support brace 32. The swing arm 44 preferably includes a downwardly depending end tab 46 which preferably extends perpendicularly downward for engagement against the interior surface of the stud 16. The pair of longitudinally-extending hinge members 48 are preferably positioned adjacent and exterior to the sides of support brace 32.

Figure 2A:
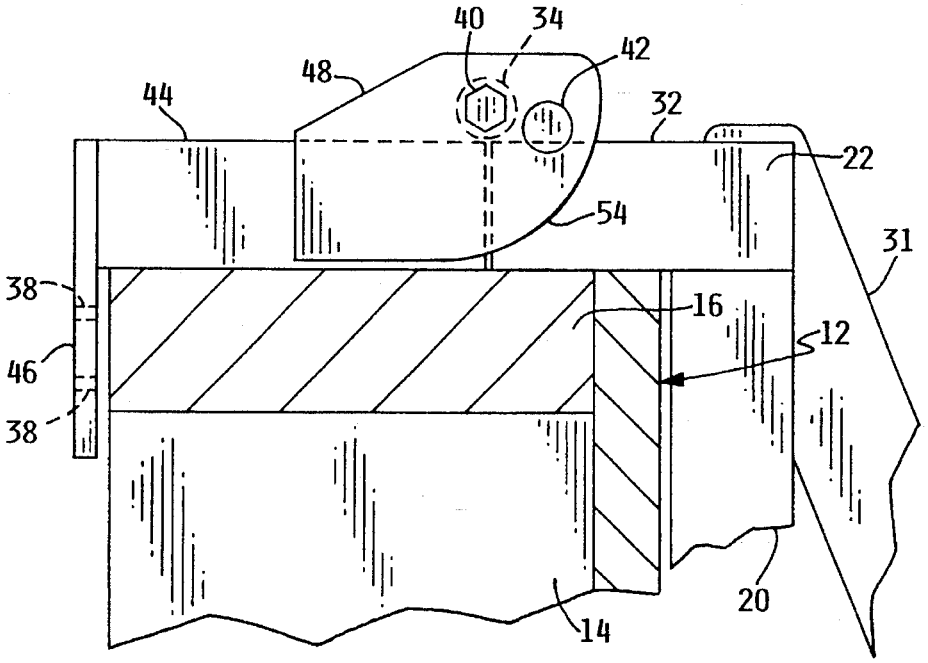
FIG. 2A is a cross-sectional side view of the hinge member of the construction wall bracket taken along line 2—2 of FIG. 1.
Figure 2B:
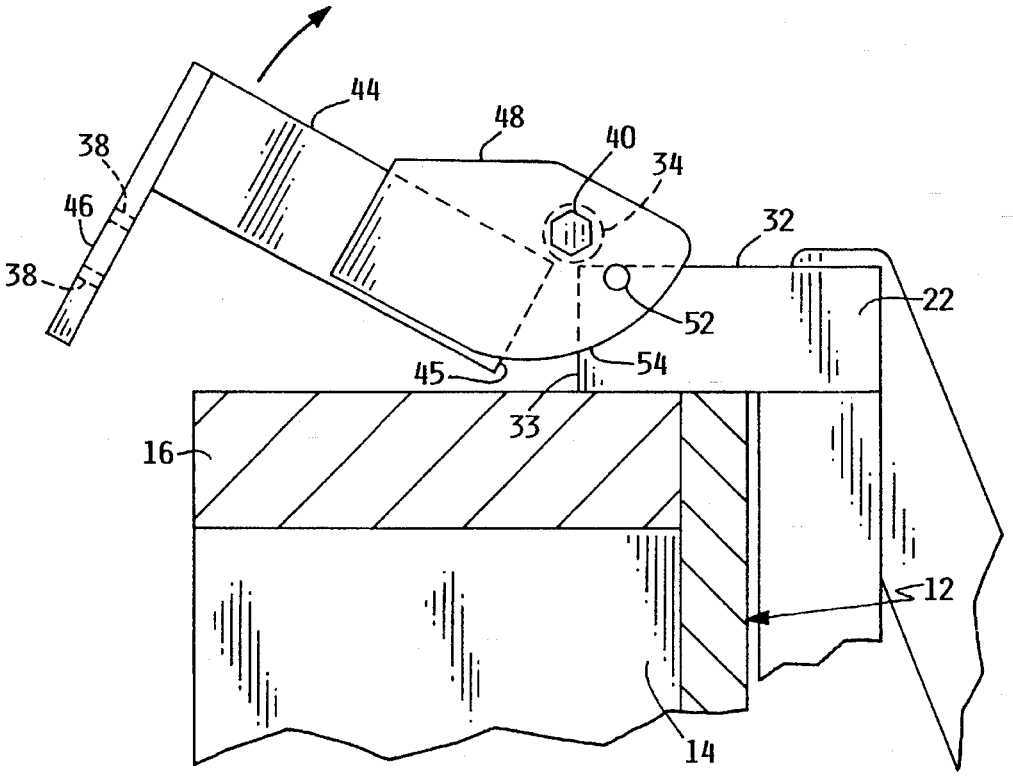
FIG. 2B is a cross-sectional side view of the hinge member of the construction wall bracket taken along line 2—2 of FIG. 1 showing the pivotal upward rotation of the swing arm.

The interior edge 33 of the support brace 32 is preferably positionable adjacent to the engagement edge 45 of the swing arm 44. The interior edge 33 and the engagement edge 45 are located above the top horizontal stud 16 as may be seen in FIGS. 2A and 2B.

The end tab 46, in operable position, is preferably located adjacent to the top horizontal stud 16 and proximate to the interior of the stud 16 opposite to the vertical member 20. The end tab 46 preferably functions to prohibit the outward sliding separation of the wall bracket 10 from the vertical wall 12. The end tab 46 is preferably used as a hanger, hook, or safety mechanism for engagement to the interior surface of the top horizonal stud 16, and preferably has one or more holes 38 to permit fastener nails to be driven through end tab 46 into stud 16. The hinge pin 40 passes through the aligned apertures 50 and the opening through tubular hinge 34 for pivotal attachment of the swing arm 44 to the support brace 32. A safety pin 42 passes through the aligned apertures 52 for locked positioning of the swing arm 44 in an operable position aligned with support brace 32.

The pair of longitudinally-extending hinge members 48 are preferably affixed to the exterior edges of the swing arm 44 by welding. Each of the pair of longitudinally-extending hinge members 48 includes an arcuate lower edge 54. The arcuate lower edges 54 enable the swing arm 44 to be pivoted upwardly without striking or contacting the top horizontal stud 16.

The swing arm 44 is upwardly pivotable about the hinge pin 40 for retraction of the end tab 46 from a hooked position over the top horizontal stud 16. The upward pivotal rotation of the swing arm 44 functions to permit the lateral sliding retraction of the wall bracket 10 from the vertical wall surface 12. The wall bracket 10 may then be slidably stored or repositioned along the vertical wall surface 12 for further use by a worker.

It should be noted that the engagement between the longitudinally-extending hinge members 48 and the swing arm 44 are of sufficient strength and durability to not fracture or fail during use of the wall bracket 10. In addition, it should be noted that the engagement between the hinge pin 40, the longitudinally-extending hinge members 48, and the support brace 32 is of sufficient strength and durability to not fracture or fail during use of the wall bracket 10.

The safety pin 42 preferably functions to prohibit the upward pivotal rotation of the swing arm 44 with respect to the support brace 32 during use of the wall bracket 10. The safety pin 42 preferably is positioned vertically above the support brace 32. The safety pin 42 is used to lock the longitudinally-extending hinge members 48 into a desired position relative to the support brace 32. The safety pin 42 is required to be withdrawn from the hinge members 48 prior to the pivotal rotation of the swing arm 44 relative to the support brace 32.

The unique arrangement between the swing arm 44 relative to the support brace 32 about the hinge pin 40 enables the wall bracket 10 to be hung against a vertical wall 12 and later removed following the erection of the rafters, roof, or ceiling joists of a residential building. The location of the hinge pin 40 has been selected and positioned between the exterior surface and interior surface of the top horizontal stud 16 in order to maximize the safety to a workman. The failure of any component of the hinge pin 40, longitudinally-extending hinge members 48, or swing arm 44 does not permit the wall bracket 10 to separate from a vertical wall 12.

The overall length of the support brace 32 and swing arm 44 may be varied by selectively providing a number of swing arm 44 components which are respectively of different lengths. For example, various construction projects may have different wall thicknesses, and the length of swing arm 44 may be chosen to accommodate 2×4, 2×6, 2×8, 2×10, and 2×12 wall thicknesses. These lengths are usually sufficient to accommodate all commonly used construction lumber, and of course the interior dimension must allow for a reasonable thickness of the outside wall covering 12. The swing arm dimension may also be selected to accommodate various masonry and concrete block constructions.

Figure 4:
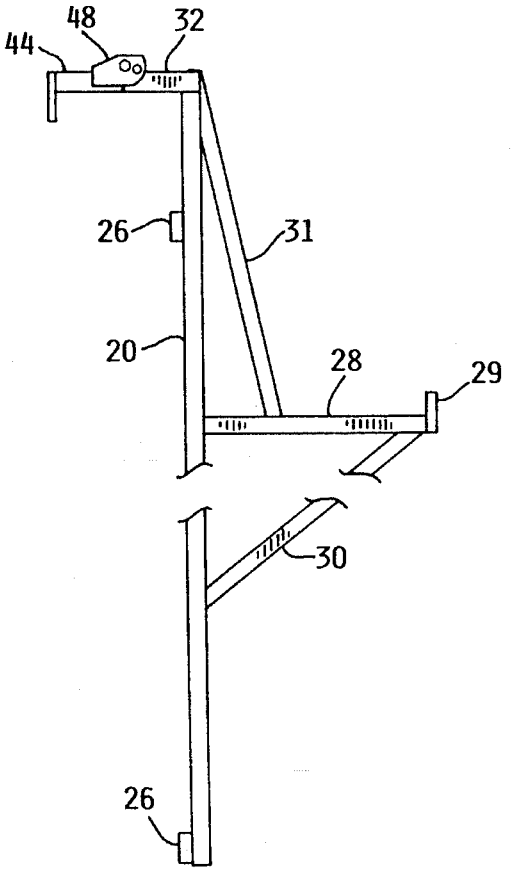
FIG. 4 is an elevation view of a first preferred form of the construction wall bracket.
Figure 5:
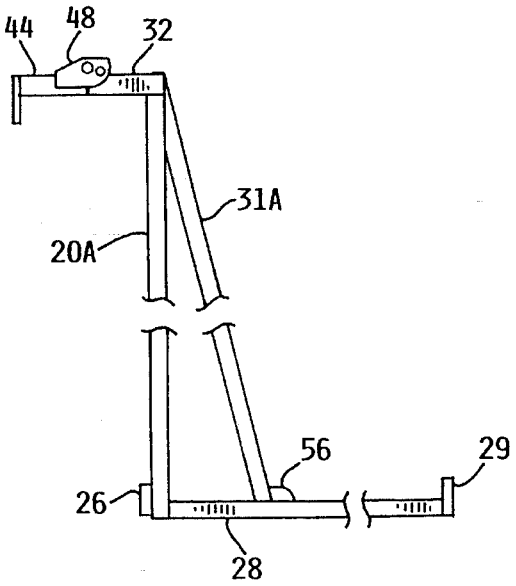
FIG. 5 is an elevation view of a second preferred form of a construction wall bracket.

FIGS. 4 and 5 show two preferred embodiments of the present invention, both of which use the identical support brace 32, swing arm 44, and hinge members 48. The differences between the two preferred embodiments relate to the length of the vertical member 20, and the support brackets for supporting the horizontal member 28. FIG. 4 shows elongated vertical member 20 having two wall engagement members 26, and having an extended portion below horizontal member 28. A lower support or angle bracket 30 is utilized in conjunction with an upper support or angle bracket 31 to firmly support the horizontal member 28. An end tab 29 is affixed to the outermost end of horizontal member 28 for securing a platform or plank, and also for providing an attachment member for a railing. FIG. 5 shows a shorter vertical member 20A, with a single wall engagement member 26 proximate the bottom end of vertical member 20A. Horizontal member 28 is supported by an upper support or angle bracket 31A, in a manner similar to that described with respect to FIG. 4. An end tab 29 is also used on the embodiment shown in FIG. 5 for the same purposes as described hereinbefore. A further feature which may be utilized in connection with the embodiment of FIG. 5 is to incorporate a hinge 56 adjacent the lower end of angle or support bracket 31A, and to form the horizontal member 28 into two sections. In this embodiment, hinge 56 will permit the upward pivotal movement of the outer portion of horizontal member 28, which is convenient for disassembly and storage of the apparatus. Hinge 56 is arranged in a manner similar to the hinge member described herein, so as to limit the downward pivotal movement of the outer portion of horizontal member 28 to a horizontal, aligned position relative to the inner portion of horizontal member 28.

A construction worker desiring to remove or adjust the positioning of the wall bracket 10 along the vertical wall 12 may easily remove the safety pin 42 and pivot the swing arm 44 upwardly about the hinge pin 40 while standing on a separate ladder. The construction worker may then slidably retract the wall bracket 10 from engagement to the vertical wall 12 and top horizontal stud 16. The wall bracket 10 may then be stored or repositioned at the discretion of a workman. The pivotal rotation of the swing arm 44 relative to the support arm 32 significantly enhances the utility of the wall bracket 10 to a workman. A construction worker is thereby not required to vertically lift a scaffold device for disengagement of a hook or hanger from the top horizontal stud 16. The engagement of the swing arm 44 to the support arm 32 as described significantly improves the ease of use of the wall bracket 10.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A construction wall bracket device for engagement against the top horizontal stud and against the vertical studs of a wall of a building, said construction wall bracket device comprising:

(a) a vertical member having upper and lower ends;

(b) at least one wall engagement member affixed to and extending laterally outward from said vertical member for engagement against said vertical wall;

(c) a horizontal member having a support bracket affixed to and extending perpendicularly outward from said vertical member;

(d) a support brace attached to and extending perpendicularly inward from said vertical member upper end for engagement against said top horizontal stud, said support brace having a hinge affixed thereto;

(e) a swing arm having a depending end tab and a pair of longitudinally-extending hinge members positioned adjacent to said support brace; and (f) a hinge pin engaged to said hinge members and to said hinge permitting upward pivotal rotation of said swing arm with respect to said support brace.

2. The construction wall bracket device according to claim 1, wherein said wall engagement member extends laterally outward from said vertical member in approximately the same plane as said vertical member and approximately the same plane as said wall.

3. The construction wall bracket device according to claim 2, said support bracket further comprising two ends where one of said ends is affixed to said horizontal member outwardly from said vertical member and said other end is affixed to said vertical member.

4. The construction wall bracket device according to claim 3, wherein said hinge further comprises a tubular member affixed to the upper side of said support brace.

5. The construction wall bracket device according to claim 4, said tubular member further comprising an opening sized to accept said hinge pin.

6. The construction wall bracket device according to claim 1, said pair of longitudinally-extending hinge members further comprising two pairs of respectively aligned apertures therethrough.

7. The construction wall bracket device according to claim 6, wherein said hinge pin is positioned within one of said two pairs of aligned apertures for permitting upward pivotal rotation of said swing arm with respect to said support brace for release of said swing arm and said depending end tab from said top horizontal stud.

8. The construction wall bracket device according to claim 7, further comprising a safety pin positioned within another of said pairs of aligned apertures for preventing pivotal upward rotation of said swing arm with respect to said support arm for retention of said swing arm and said support brace upon said top horizontal stud.

9. A construction wall bracket device for engagement to the top horizontal stud and to the vertical studs of a wall of a building, said construction wall bracket device comprising:

(a) a vertical member;

(b) at least one stud engagement member affixed to and extending laterally outward from said vertical member in approximately the same plane as said vertical member and approximately the same plane as said wall, said stud engagement member contacting said vertical studs for preventing said construction wall bracket from rotating through said vertical studs;

(c) a horizontal member affixed to and extending perpendicularly outward from said vertical member;

(d) a support bracket having two ends where one of said ends is affixed to said horizontal member opposite to said vertical member and said other end is affixed to said vertical member below said horizontal member;

(e) a support arm attached to and extending perpendicularly inward from said vertical member for engagement to said top horizontal stud, said support arm having hinge affixed thereto;

(f) a swing arm having a depending end tab, said swing arm for positioning upon said top horizontal stud and said depending end tab for positioning adjacent said top horizontal stud, said swing arm further having a pair of longitudinally-extending hinge members for positioning adjacent to said hinge;

(g) a hinge pin engaged to said hinge members and to said hinge permitting upward pivotal rotation of said swing arm with respect to said support arm for release of said swing arm and said depending end tab from said top horizontal stud; and (h) a safety pin removably engaged to said hinge members and to said hinge for preventing pivotal upward rotation of said swing arm with respect to said support arm for retention of said swing arm and said support arm upon said top horizontal stud.

10. A construction wall bracket device for engagement to the top horizontal stud and to the vertical studs of a wall of a building, said construction wall bracket device comprising:

(a) a vertical member having an upper end and a lower end;

(b) at least one stud engagement member affixed to and extending laterally outward from said vertical member in approximately the same plane as said vertical member and approximately the same plane as said wall, said stud engagement member contacting said vertical studs preventing said construction wall bracket from rotating through said vertical studs;

(c) a horizontal member affixed to and extending perpendicularly outward from said vertical member;

(d) a support bracket having two ends where one of said ends is affixed to said horizontal member opposite to said vertical member and said other end is affixed to said vertical member below said horizontal member;

(e) a support arm attached to and extending perpendicularly inward from said upper end of said vertical member for resting upon and engagement to said top horizontal stud, said support arm having hinge affixed thereto;

(f) a swing arm having a depending end tab, said swing arm for positioning upon said top horizontal stud, and said depending end tab for positioning adjacent said top horizontal stud opposite to said vertical member, said swing arm further having a pair of longitudinally-extending hinge members having a first and second pair of aligned apertures therethrough, said hinge members being positioned adjacent to said hinge for alignment therewith;

(g) a hinge pin engaged to said hinge members and to said hinge though said first pair of apertures for permitting upward pivotal rotation of said swing arm with respect to said support arm for release of said swing arm and said depending end tab from said top horizontal stud; and (h) a safety pin removably engaged to said hinge members and to said hinge through said second pair of apertures for preventing pivotal upward rotation of said swing arm with respect to said support arm for retention of said swing arm and said support arm upon said top horizontal stud.

* * * * *